US008545376B2

(12) United States Patent
Spink

(10) Patent No.: US 8,545,376 B2
(45) Date of Patent: Oct. 1, 2013

(54) PUNCHED OUT TABS

(75) Inventor: Timothy David Jonathan Spink, Welwyn (GB)

(73) Assignee: Xerox Corporation, Norwalk, CT (US)

( * ) Notice: Subject to any disclaimer, the term of this patent is extended or adjusted under 35 U.S.C. 154(b) by 979 days.

(21) Appl. No.: 12/408,283

(22) Filed: Mar. 20, 2009

(65) Prior Publication Data

US 2009/0181839 A1 Jul. 16, 2009

Related U.S. Application Data

(63) Continuation of application No. 11/761,757, filed on Jun. 12, 2007, now abandoned.

(51) Int. Cl.
*B31B 49/00* (2006.01)

(52) U.S. Cl.
USPC ..... 493/353; 493/356; 493/375

(58) Field of Classification Search
USPC ..... 493/353, 356, 116, 117, 375, 376, 493/378, 961
See application file for complete search history.

(56) References Cited

U.S. PATENT DOCUMENTS 766,905 A * 8/1904 Ruth ..... 493/351
768,484 A * 8/1904 Ruth ..... 493/351
803,709 A 11/1905 Perrine
1,974,203 A * 9/1934 Collins ..... 2/68
2,034,413 A 3/1936 Ottinger
2,300,623 A 11/1942 Hornung
2,331,252 A * 10/1943 Van Tuyl ..... 493/351
2,400,211 A * 5/1946 Rubinoff ..... 462/67
2,823,784 A * 2/1958 Ambrose ..... 400/703
2,889,146 A * 6/1959 Thompson ..... 493/353
2,941,819 A 6/1960 Groody
3,409,312 A 11/1968 Wills
3,528,602 A * 9/1970 Ritchie ..... 229/67.1
3,561,147 A 2/1971 Valencia
3,583,558 A * 6/1971 Davis ..... 242/160.1
3,792,672 A * 2/1974 Friedman et al. ..... 112/104
4,184,699 A 1/1980 Lowe, Jr.
4,573,821 A 3/1986 Gilreath
5,540,513 A 7/1996 Wyant
5,875,579 A 3/1999 Winzen
5,908,259 A 6/1999 Johnson
5,909,979 A 6/1999 Winzen
6,375,604 B1 4/2002 Verhines
6,383,125 B1 * 5/2002 Schwarz ..... 493/356
6,409,409 B2 6/2002 Bauman et al.

* cited by examiner

*Primary Examiner* — Sameh H. Tawfik
(74) *Attorney, Agent, or Firm* — Oliff & Berridge, PLC

(57) ABSTRACT

A system and method are provided for creating tabs from regular cut-sheet stock after printing by partially punching out a section of a sheet and folding the punched out section back on itself at the remaining side. The location of the punched out section is such that when folded back, a portion of the punched out section sticks out beyond the border of the original paper size. Tab labels may be printed on the back side of the sheet so that when folded out, the tab label is in the correct orientation, i.e., facing front on the folded out tab. The punch head, which is used to punch out the section of the sheet, may be oriented flexibly and moved outboard or inboard. Tabs may be cut and folded to produce a readable set of tabs along any of the top, bottom, lead or trail edges of a sheet.

8 Claims, 3 Drawing Sheets

PUNCHED OUT TABS

This is a Continuation of application Ser. No. 11/761,757 filed Jun. 12, 2007. The entire disclosure of the prior application is hereby incorporated by reference herein in its entirety.

BACKGROUND

This disclosure generally relates to single or multifunction printers and copiers, and specifically relates to media handling, such as feeding, transport and finishing.

Sheets of media (e.g., paper) called tab stock, with preformed tabs, are generally used for inserting tab media into a document to section a document. Tab stock may cause jams when it is transported through a machine because one of the edges of the tab stock is not square and the tab sticking out may catch on something as it is transported through the machine. In addition, productivity may be lost as jams are more likely when the machine is feeding regular stock from one tray and then switches trays to feed the tab stock. Productivity is lost because of the time delay and the re-synchronization required a jam occurs part way through a job. Furthermore, a machine operator may have trouble orienting the tab stock in the tray so that the tabs come out on the correct edge when delivered or even printed in the correct place.

SUMMARY

Exemplary embodiments include various aspects of a system and method for creating tabs from regular cut-sheet stock after printing by partially punching out a section of a sheet and folding the punched out section back on itself at the remaining side. The location of the punched out section is such that when folded back, a portion of the punched out section sticks out beyond the border of the original paper size. Tab labels may be printed on the back side of the sheet so that when folded out, the tab label is in the correct orientation, i.e., facing front on the folded out tab. A punch head, which is used to punch out the section of the sheet, may be oriented flexibly and moved outboard or inboard or include multiple punches. Tabs may be cut and folded to produce a readable set of tabs along any of the top, bottom, lead or trail edges of a sheet. Applications include tabbed documents with flexible tab location options. Tabs may provide a more robust, visual means of separating jobs at a printer. Tabs may be provided with or without special media.

One aspect is a method for creating tabs in a sheet of media as a finishing option in a copying and/r printing machine. One section of a sheet is partially punched out. Multiple sections may also be partially punched out of the sheet. The sheet has a front side and a reverse side. The punched-out section is folded so that the punched-out section extends beyond an edge of the sheet. The folded, punched-out section has a front side and a reverse side corresponding respectively to the reverse and front side of the sheet. The punched-out section is delivered to an output tray. A tab label may be printed on the reverse side of the sheet so that the tab label appears on the front side of the folded, punched-out section. The sheet may be received from the same input tray as the rest of the sheets in the job or from a different input tray. The sheet may be of the same stock as the rest of the sheet in the job or a different stock. An image may already be printed on the sheet before partially punching out and folding the section. The sheet with the partially punched-out and folded section may be used to separate two different jobs in the output tray. A page number(s) may be received identifying which sheet(s) in the job is to be partially punched-out and folded.

Another aspect is a finisher in a copying and/or printing machine for creating tabs, including means for partially punching out a section of a sheet, means for folding the punched-out section so that the punched-out section extends beyond an edge of the sheet, and means for delivering the sheet to an output tray. The sheet has a front side and a reverse side. The folded, punched-out section has a front side and a reverse side corresponding respectively to the reverse and front side of the sheet. The finisher may also include means for printing a tab label in on the reverse side of the sheet so that the tab label appears on the front side of the folded, punched out section. The finisher may also include means for receiving the sheet from the same input tray as the rest of the sheets in the job or from a different input tray. The finisher may also include means for receiving the sheet and sheets for the rest of the job including the sheet from the same or different input trays holding different stock so that the sheet has the same or different stock as the rest of the job. The finisher may also include means for already printing an image on the sheet, before partially punching-out and folding the section. The finisher may also include means for separating jobs in the output tray with the partially punched-out and folded section.

Yet another aspect is a finisher in a copying and/or printing machine for creating tabs on a sheet of media, including a backing plate, a punch head, a folder bar and an output tray. The punch head partially punches out a section of a sheet against a backing plate. Then, the folder bar folds the punched-out section so that the punched-out section extends beyond one of the edges of the sheet. The output tray delivers the punched-out, folded sheet. The punch head may rotate in order to make punch outs in various locations or orientations. The backing plate may be a floating backing plate with a plurality of holes for making punch outs in various locations or orientations.

EMBODIMENTS

Figure 1A:
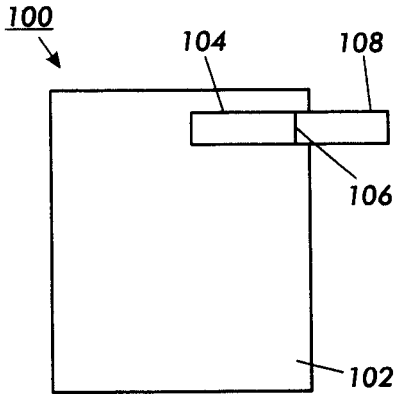
FIGS. 1A, 1B, 1C and 1D illustrate various exemplary embodiments of punched-out tabs.
Figure 1B:
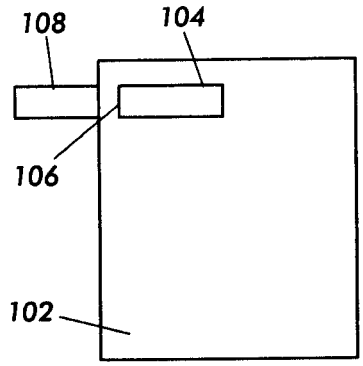
Figure 1C:
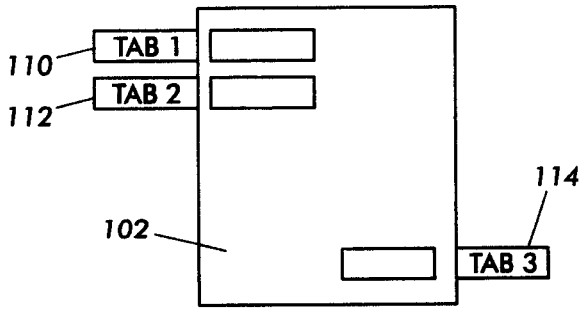
Figure 1D:
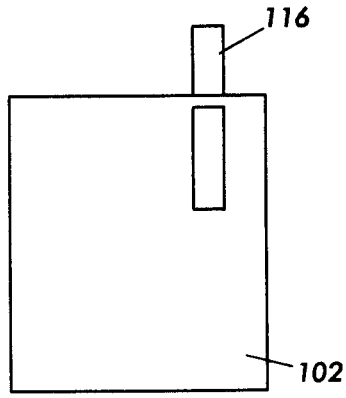

Exemplary embodiments include a system and method for providing one or more tabs on a sheet of media as a finishing option selectable on a printing and/or copying machine. A tab may be partially punched out and then folded back on itself on the sheet of media so that the tab sticks out from an edge of the sheet of media. There is a wide variety of applications from tabs as separators between jobs to tabs on banner sheets to multiple tabs and many other applications. A job is one or more sheets being processed together by the machine. The media may be marked on the reverse side of the sheet at the position of the tab so that the annotation is visible from the front. The tab may be disposed in any position of the sheet of media, such as left side, right side, top, bottom, or any combination of positions (e.g., tabs on left and right).

FIGS. 1A, 1B, 1C and 1D illustrate various exemplary embodiments of punched-out tabs. The tab stock 100 contains a sheet of media 102 having a plurality of tabs (108/110/112/114/116). Tabs (108/110/112/114/116) may be created as part of a finishing process by partially punching out a strip or section of a sheet of media 102. Any shape (e.g., triangular) or size section may be punched out, so long as there is a non-cut side or region to fold back. The punched out tab may be smaller than the size of the sheet and the punched out tab may leave a hole 104 in the sheet. In one embodiment, another sheet is adhered to the tabbed sheet to cover or reinforce hole(s) that may be left in the sheet where the tab(s) was punched out. Any orientation or angle of the tab may be punched out, e.g., a tab at a 45 degree angle to a side of the sheet. Any number of tabs may be punched out in any configuration on a sheet (e.g., five along one side, one on each side).

After being punched out, the tab may be folded at a tab folding point 106, to fold the tab back on itself so that the tab extends beyond one of the edges of the sheet. The amount and shape of the portion of the tab that extends beyond any one of the edges may vary. The tab may also extend out from the body of the job (i.e., sheet or stack of sheets) in the output tray. In one embodiment, banner sheets are used to separate multiple jobs at the output device. A conventional way of achieving multiple job separation is to offset each job, however, when the job is removed by a person, the offsetting may be lost. To simplify or improve job separation, a tab may be introduced onto the banner sheet as a finishing option so that the standard paper may still be used for the banner sheet. In one embodiment, tab sheets are used in the same way as preformatted tab sheets in the related art. However the media type may be different, e.g., plain paper, card stock, colored paper or a mixture of medias used in the same document.

It may be advantageous for a machine operator to print, for example, a 20 page document with a printing and/or copying machine and to insert a tab on every fifth page, i.e., pages 5, 10 and 15. In that case, in one embodiment, a user interface for a machine accepts information about where the user wants to place the tabs and information about tab labels. In another embodiment, a job is submitted from another machine in communication with the machine with instructions indicating where the tabs are to be formed and the image or text for tab labels, such as a print job from a personal computer connected to a printer on a local area network.

In the related art, one input tray would be loaded with tab stock and another input tray would have plain paper. In one embodiment of the presently described exemplary embodiments, only one input tray with plain paper need be used for both the 20 page document and the tabs. In one embodiment, the tabbed pages also contain images for the document, while in another embodiment, the tabbed pages are blank or contain only tab labels (printed on the reverse side of the tab section so that they face forward when folded out).

Some kinds of tab stock may be pre-labeled, for example, A, B, C . . . or 1, 2, 3 . . . . When using such tabs, if there is a jam or error, a whole sequence of tab stock may need to be thrown out, the job cancelled and restarted from the beginning or the input tray with the tab stock may need to be reloaded to start at a particular label, such as 3. In one embodiment, if there is a jam or error, a tab page may simply be reprinted at any point in a sequence of tabs, without any need to discard stock or reload stock. In one embodiment, inserting a tab on a page merely requires a finishing option to be selected for that page. In one embodiment, the same media is used for both tab pages and untabbed pages, while in another embodiment different media is used for tab pages. In one embodiment, a user interface provides a varying level of tab finishing options, such as permitting tabs only in one particular way with only one input tray on one machine while allowing a wide range of tab finishing options on another machine with multiple selections for multiple input trays with varying media stock.

Figure 2:
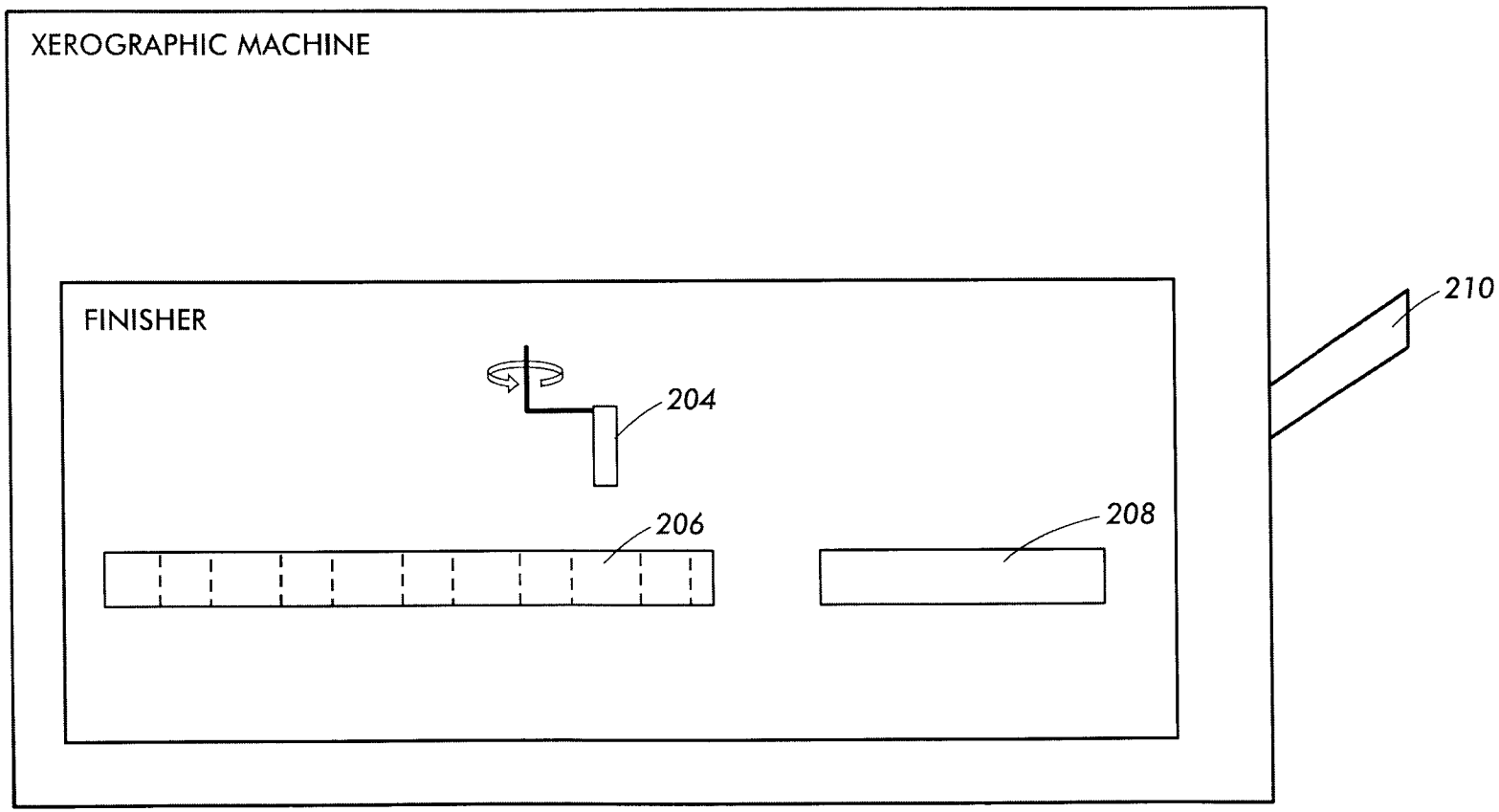
FIG. 2 illustrates an exemplary embodiment of a finisher in a machine for creating punched-out tabs.

FIG. 2 illustrates an exemplary embodiment of a finisher 202 in a machine 200 for creating punched-out tabs. The finisher 202 includes a punch head 204, a backing plate 206, a folder bar 208, and an output tray 210. Tabs are formed when the punch head 204 performs a punching out action followed by a the folder bar 208 performing a folding action. In other embodiments, various devices may perform punching out actions and/or folding or creasing actions at one or more various orientations on a page.

In one embodiment, the punching out and folding actions are performed just prior to delivering the tabbed sheet to the output so that the tabbed sheet free falls into the output tray. In one embodiment, the tabbed sheet falls a short distance into the output tray, such as, for example, an inch or so. In one embodiment, a de-skew mechanism adjusts the tabbed sheet on its path to the output tray. In another embodiment, the tabbed sheet is transported to the output tray. In one embodiment, a floating punch head rotates about various axes to punch tabs at various locations on a sheet and the punch head is controlled by a controller or actuator. In one embodiment, locations for punch tabs may be limited, such as only on the left edge.

In one embodiment, a tab label or annotation is preprinted on the reverse side of the sheet and then a three sided punch tool punches the tab into the backing plate so that when the punch tool punches the tab, the sheet does not tear. In one embodiment, the backing plate is slightly bigger than the hole punched out. In one embodiment, there is a floating punch head and a floating backing plate. In another embodiment, there is a floating punch head and a backing plate having numerous hole locations for engaging the punch head (e.g., five slots on the left and five slots on the right). In one embodiment, a slider bar or folding arm bends the tab by rising up and smoothing over the paper and folding the tab back in various positions.

Figure 3:
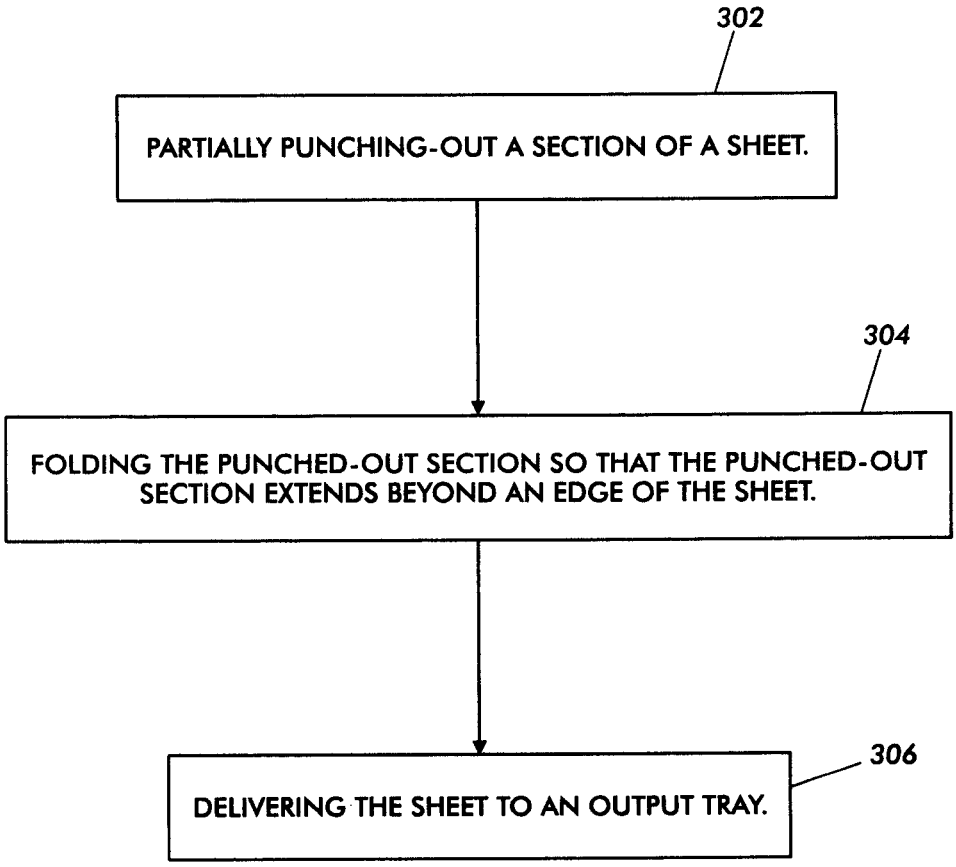
FIG. 3 illustrates an exemplary embodiment of a method of creating punched-out tabs.

FIG. 3 illustrates an exemplary embodiment of a method of creating punched-out tabs 300. At 302, a section of a sheet is partially punched-out. At 304, the punched-out section is folded so that the punched-out section extends beyond one of the edges of the sheet. At 306, the punched-out, folded sheet is delivered to the output tray.

In one embodiment, a section of a sheet is partially punched out. The punched-out section is folded so that the punched-out section extends beyond an edge of the sheet and then delivered to an output tray. A tab label may be printed on a reverse side of the sheet so that the tab label appears on a front side of the folded tab, once it is punched out and folded. The sheet may be from the same input tray as the rest of the sheets in the job or from a different input tray. The sheet may be of the same stock as the rest of the sheet in the job or a different stock. An image may already be printed on the sheet before the partial punching out and folding. The sheet may be used to separate jobs in the output tray. A page number(s) may be received identifying which sheet(s) in the job to be partially punched-out and folded.

The exemplary embodiments have many advantages. A machine may continue feeding from one tray for both the body of the job and the tab sheets, as opposed to switching from a tray holding stock for the body of the job to a tray for feeding tab stock. Switching trays may cause lost productivity and makes jams more likely. Exemplary embodiments introduce tabs at the end of a printing or copying process so that jams are less likely than when tab stock must be transported through a machine. By waiting to create the tab as a finishing option, there is less of an opportunity for problems to occur.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A finisher in a machine for creating tabs on a sheet of media, comprising:

a backing plate;

a three-sided head that partially punches out at least one section of the sheet against the backing plate without tearing the sheet, the sheet having a front side and a reverse side;

a folder bar that smoothes and bends the punched-out section so that the punched-out section extends beyond an edge of the sheet, the folded, punched-out section having a front side and a reverse side corresponding, respectively, to the reverse and front side of the sheet; and an output tray that receives the sheet.

2. The finisher of claim 1, wherein the three-sided head rotates.

3. The finisher of claim 1, wherein the backing plate is a floating backing plate with a plurality of holes.

4. The finisher of claim 1, further comprising:

a printing device that prints a tab label on the reverse side of the sheet so that the tab label appears on the front side of the folded, punched-out section.

5. The finisher of claim 4, wherein, the printing device can print an image on the sheet before partially punching out and folding the punched-out section.

6. The finisher of claim 1, wherein, the sheet the sheet is fed from a same input tray as a job including the sheet.

7. The finisher of claim 1, wherein, the sheet the sheet is fed from a different input tray as a job including the sheet.

8. The finisher of claim 1, wherein the folder bar bends the punched-out section such that a fold is perpendicular to a side of the punched-out section.

* * * * *